United States Patent [19]

Cole

[11] 4,029,016

[45] June 14, 1977

[54] PLURAL MODE FUZE

[75] Inventor: Lewis C. Cole, Chester, N.J.

[73] Assignee: The United States of America as represented by the Secretary of the Army, Washington, D.C.

[22] Filed: June 29, 1976

[21] Appl. No.: 700,992

[52] U.S. Cl. ..... 102/69; 102/7.2; 102/70 R; 102/74; 102/76 P

[51] Int. Cl.[2] ..... F42B 13/50; F42B 25/16; F42C 9/00

[58] Field of Search ..... 102/69, 68, 7.2, 70 R, 102/76 P, 75, 74

[56] References Cited

UNITED STATES PATENTS

| | | | |
|---|---|---|---|
| 174,325 | 2/1876 | Tyler | 102/69 X |
| 2,454,281 | 11/1948 | Hicks | 102/69 X |
| 2,487,789 | 11/1949 | Carr et al. | 102/70 R |
| 3,702,589 | 11/1972 | Erbert | 102/70 R |
| 3,971,319 | 7/1976 | Larson | 102/70 R X |
| 3,981,239 | 9/1976 | Czajkowski et al. | 102/7.2 |

*Primary Examiner*—David H. Brown
*Attorney, Agent, or Firm*—Nathan Edelberg; A. Victor Erkkila

[57] ABSTRACT

A plural mode fuze with a bimetallic spring delay module providing delay arming, impact functioning, random time detonating and/or self-destruct functioning of a munition. The fuze includes a cup containing a detonator and a safing and arming means, a striker cup slidably nested therein, and an intermediate compression spring for moving the cups oppositely from a safe position to an armed position. The striker cup contains a fixedly mounted bimetallic spring delay module, which includes a bimetallic Belleville spring containing a firing pin, a pyrotechnic charge for heating the spring, a heat sink and thermal insulation means. The fuze has a means for locking the Belleville spring when it inverts by heat from the pyrotechnic charge, whereby the Belleville spring overcomes the compression spring. Impact of the fuze with the ground, prior to the expiration of the first delay period required to invert the Belleville spring, pushes back the striker cup, thereby overcoming the compression spring and driving the firing pin into the detonator. After expiration of said first delay period, the bimetallic Belleville spring, held by the locking means, inverts without moving the firing pin, thereby overcoming the compression spring and drawing the cups together so that the striker cup cannot move toward the detonator. In the latter condition the fuze cannot impact function but self-destruct functions when the Belleville spring snaps back after expiration of the second delay period required to revert said spring by cooling, thereby driving the firing pin into the detonator.

12 Claims, 7 Drawing Figures

PLURAL MODE FUZE

GOVERMENTAL INTEREST

The invention described herein may be manufactured, used and licensed by or for the Government for Govermental purposes without the payment to me of any royalties thereon.

BACKGROUND OF THE INVENTION

Various types of fuzes are employed to initiate munitions. Impact fuzes function by actual contact with the target. Delay or time fuzes initiate the munition at some time after launch, drop, emplacement or impact with the target. Such delay fuzes are generally settable at the time of use, and the timing function is provided by means of such devices as clockwork, electronic circuitry and chemical and pyrotehnic reactions. Some munitions are provided with self-destruct capability in addition to the impact or time delay feature to explode the munition in case of target miss or failure of the primary fuze mode.

Plural mode fuzes, i.e., fuzes possessing multiple functioning such as delay arming, impact detonating and self-destruct functioning, generally utilize complex mechanical, electrical and/or chemical activating means. This complexity of design increases the cost as well as the possibility of performance failure of one or more of the many parts of the fuze. Accordingly, a need exists for a simpler, more reliable plural mode fuze for munitions.

SUMMARY OF THE INVENTION

An object of the present invention is to provide a fuze having a bimetallic spring delay module.

Another object of the invention is to provide a fuze containing a bimetallic spring delay module, which imparts delay arming, impact detonating functioning and self-destruct functioning to a munition.

A further object of the invention is to provide a munition, e.g., a random detonating munition (which may be a mine if it includes disturbance means) containing a fuze of relatively simple design possessing a bimetallic spring delay module capable of providing delay arming, impact detonating and selfdestruct or random detonation functioning of the munition.

A still further object of the invention is to provide a shell or projectile to be fired from a gun to distribute a multiplicity of random detonating submunitions containing bimetallic spring delay modules of differing thermal and hence time delay functioning characteristics.

Other objects will become obvious as the invention is further described.

These and other objects are achieved according to the present invention by means of a fuze, which comprises in combination:

- a cup containing a detonator and a safing and arming means;
- a striker cup slidably nested in said cup;
- a bimetallic spring delay module fixedly mounted in said striker cup comprising

- a bimetallic spring containing a firing pin, and
- a pyrotechnic charge for heating the spring, said spring being invertible from a first stable position to a second stable position after expiration of a first predetermined delay period following ignition of said pyrotechnic charge, and revertible to said first position on cooling after expiration of a second predetermined delay period;
- a biasing means intermediate said cups for moving the cups oppositely, whereby the fuze is converted from a safe to an armed condition via said safing and arming means;
- a means for locking the bimetallic spring when it inverts, so that during such inversion the spring overcomes said biasing means without contact of the firing pin with the detonator, and thereby moves and seats the striker cup against the other cup so as to prevent further movement of the striker cup toward the detonator; whereby: a. prior to the expiration of the first delay period required to invert the bimetallic spring, impact of the fuze with the ground overcomes said biasing means and thereby drives the firing pin into the detonator; and b. after expiration of said first delay period, the bimetallic spring inverts while held by said locking means, thereby overcoming said biasing means and locking the cups together so as to prevent movement of the striker cup toward the detonator, whereby the fuze cannot impact function but self-destruct functions when the bimetallic spring reverts on cooling after expiration of said second delay period and thereby drives the firing pin into the detonator.

The delay time is a function of the rate at which the heat generated by the pyrotechnic composition is stored in the bimetallic spring element and dissipated therefrom which in turn depends on such factors as the nature of the bimetallic spring element, thermal insulation, pyrotechnic composition, etc. The delay time can be preset by suitable selection of these factors.

Thus, a fuze embodying the bimetallic delay module of the present invention provides delay arming, impact functioning and delay functioning (including self-destruction) of a munition. Further, by means of the present invention it is possible to provide a projectile capable of dispersing a multiplicity of random detonating sub-munitions by incorporating therein a multiplicity of sub-munitions containing bimetallic spring delay modules of different thermal and hence time delay characteristics and bypassing or eliminating the impact functioning capability of the fuze.

The plural mode fuze of the present invention represents an improvement over the fuze described in my co-pending U.S. Pat. application for "Fuze With Bimetallic Spring Delay Module" Ser. No.l 700,993, filed of even date.

BRIEF DESCRIPTION OF THE DRAWING

The foregoing and other objects, features and advantages of the present invention will become apparent from the following specification thereof taken in conjunction with the accompanying drawings in which.

DETAILED DESCRIPTION OF THE INVENTION

Figure 1:
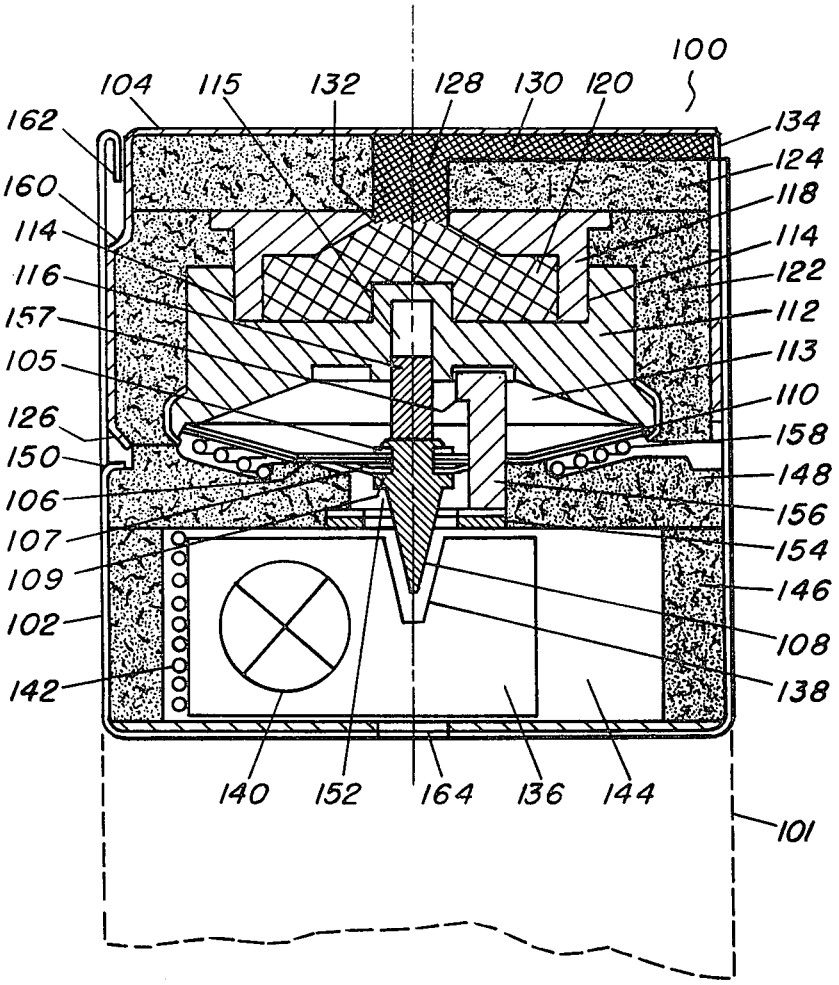
FIG. 1 is a longitudinal section view of a munition embodying a fuze of the present invention in a safe position.

Referring to FIGS. 1–5, the fuze 100 comprises a cylindrical cup 102 containing a detonator and safing and arming assembly, and an inverted striker cup 104, containing a bimetallic spring delay module and slidably nested in cup 102. The delay module comprises a bimetallic Belleville spring 106 consisting of two discs of different metals laminated together and containing a firing pin 108 coaxial with the longitudinal fuze axis and pointed toward the detonator and safing and arming assembly. The firing pin 108 is mounted in a center bore of the bimetallic disc spring 106 by swaging over a washer 105. For added strength in the center around the firing pin the bimetallic spring 106 is provided with ribs 107 which rest on a flange 109 in the firing pin. The bimetallic spring 106 is held by its perimeter in a mating flange 110 of a cylindrical metallic heat sink member 112, which contains a recess 113 at one end to accommodate the inversion of the bimetallic spring 106 and a large axial bore 114 on its other end. In the end containing recess 113 the heat sink member 112 contains a bore 115 which is coaxial with the firing pin 108 and contains a freely slidable guiding piston 116, which contacts the rear of the firing pin 108. A second cup-like metallic heat sink 118 fits with its open end into the bore 114 of heat sink member 112, thereby forming a chamber 120 which is filled with a pyrotechnic composition. The heat sink assembly is supported by the rigid annular insulation members 122 and 124, which are held in place against the bottom of the striker cup 104 by the crimped rim 126 of said cup. The annular insulation member 124 contains an axial channel 128 and a radial channel 130 communicating therewith, which are filled with an initiation mixture. Channel 128 communicates with chamber 120 containing the pyrotechnic composition through an axial opening 132 in heat sink member 118, while channel 130 communicates with the exterior of the fuze through an opening 134 in the sidewall of striker cup 104.

The safing and arming (S&A) assembly consists of a cylindrical slider136, which contains a recess 138 for receiving the point of the firing pin 108 and a bore 140 filled with a detonator charge 141. The slider 136 is provided with a compression spring 142 for urging the slider forward when the firing pin is removed from the recess 138. The S&A assembly is contained in a cylindrical chamber 144 in a rigid cylindrical insulation member 146, which rests on the bottom of cup 102. Another rigid annular insulation member 148 rests on insulation member 146 and is locked in place by crimped ears 150 punched out from the sidewall of cup 102. The rigid insulation member 148 contains an axial opening 152 in which the annular base 154 of an inversion post 156 is mounted. The inversion post 156 extends parallel to the longitudinal fuze axis through a slot (not shown) in the bimetallic Belleville spring 106, and is provided at its upper end with a catch 157 for stopping the travel of the bimetallic spring 106. A compression spring 158 supported on the rigid insulation member 148 presses against the bimetallic spring 106 and thus urges the striker cup 104 upward in cup 102. The sidewall of the striker cup 104 contains a setback having a step 160 for engaging a projection 162 in the rim of cup 102, thereby limiting the travel of cup 104, when the pressure thereon to overcome spring 158 is removed, to the same point as determined by the catch 157.

FIG. 1 shows the fuze 100 in the safe condition, wherein the slider spring 142 is compressed so that the slider recess 138 and the firing pin 108 are co-axially aligned and the striker cup 104 is pushed into the detonator cup 102 sufficient to overcome the compression spring 158 and project the firing pin 108 into the slider recess 138. The fuze is attached to a cylindrical casing 101 of a munition partially shown by dotted lines, which contains the main explosive charge.

Figure 6:
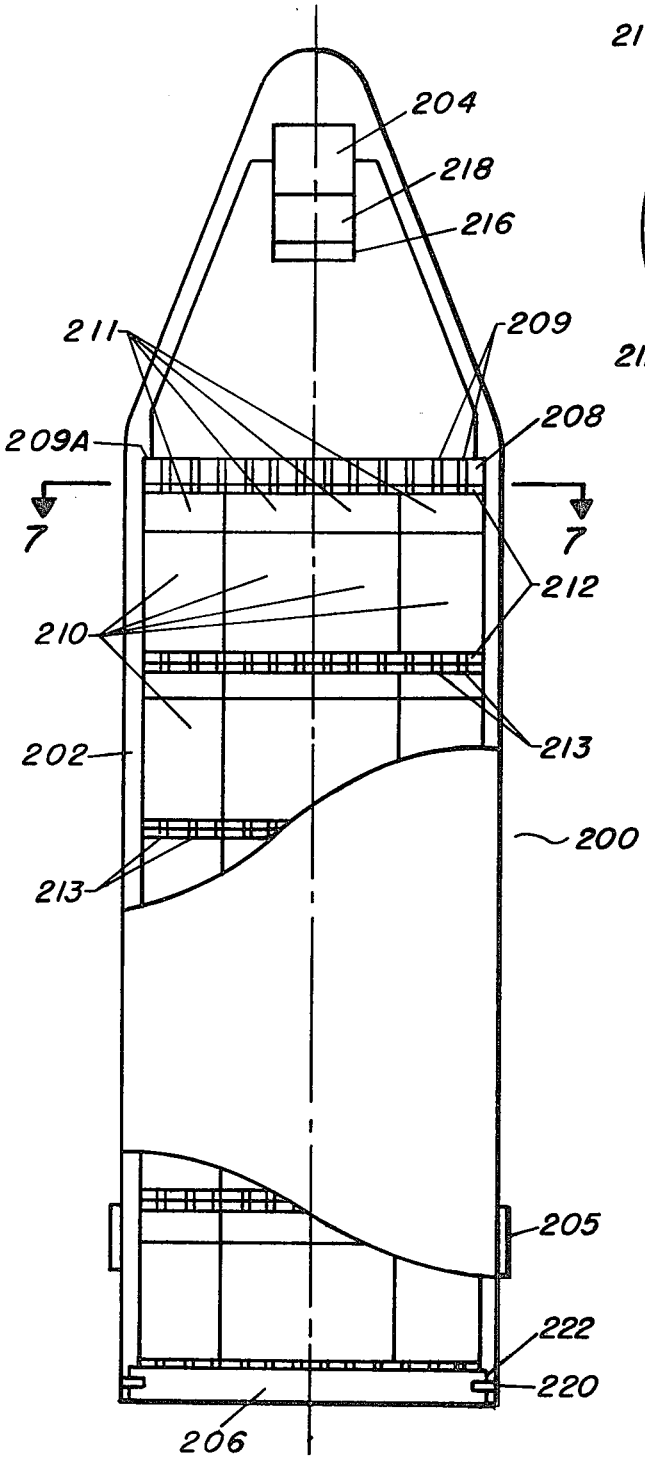
FIG. 6 illustrates a longitudinal section through an artillery projectile for delivering munitions provided with fuzes of the present invention.

Munitions provided with fuzes containing bimetallic spring delay modules of the present invention can be loaded in the safe condition into a suitable container, e.g., a projectile as shown in FIG. 6, and delivered and dispersed into a desired target area. The impact functioning and random detonation functioning of such munitions, which are more fully described below, can be selected at the gun firing sight. The time delay for the bimetallic spring to invert by heat would ordinarily be selected at approximately 10 seconds. In this mode if the primary fuze of the projectile is set to give a burst height of under 1500 feet, the munitions will impact the ground within 10 seconds and hence function on impact. However, if the burst height is above 1500 feet the munitions will not impact the ground in less than 10 seconds and consequently the bimetallic spring will invert and lock out the impact functioning capability of the munition. Thereafter the bimetallic spring will revert by cooling and self-destruct the munition after a predetermined delay period, e.g., 30 minutes.

Figure 7:
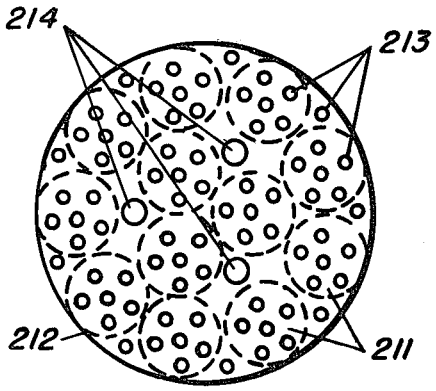
FIG. 7 is a cross-section view taken in the plane of line 7—7 of FIG. 6.

FIG. 6 illustrates a spin-stabilized projectile, which can be fired from a cannon and is suitable for delivering a number of submunitions containing fuzes of the present invention. The projectile 200 comprises a casing 202 having a nose portion containing a conventional time fuze 204, and a main portion containing a rotating band 205 and a rear closure plug 206. In the space between the closure plug 206 and a removable plate 208, which contains perforations 209 and rests on annular flanges 209A in the nose end of the projectile, are placed the cylindrical submunitions 210 containing fuzes 211 of the type described above. The submunitions are assembled symmetrically about the central axis of the projectile in tiers between plates 212, which contain a large number of perforations 213 and are held together by standoff rods 214 shown in FIG. 7. During assembly, the fuzes are maintained in the safe condition shown in FIG. 1 by suitable means, e.g., screws (not shown) extending through the top of the striker cup 104 into the cup 102 containing the detonator. These screws are removed via the holes 213 in the perforated plates 212 when the tier assemblies are loaded into the projectile. The time fuze 204 is adapted to initiate a first explosive charge 216, which generates a flame and a low pressure, e.g., 1000 psi, and thereafter a second explosive charge 218, which generates a high gas pressure, e.g., 20,000 psi. The closure plug 206 is held by shearpins 220 in the flanged projectile rim 222. After the projectile is fired from the cannon, the time fuze 204 initiates the first explosive charge 216 which projects a flame through the perforations in plates 208 and 212 and ignites the pyrotechnic charges in the fuzes of the submunitions via the sidewall openings 134 shown in FIG. 1. Immediately thereafter the time fuze initiates the second explosive charge 218, which generates sufficient gas pressure to rupture the shearpins 220 and eject plate 208 as well as the closure plug 206 and the tiers of submunition assemblies from which the mines are thrown out by the centrifugal force developed by the spinning projectile.

Figure 2:
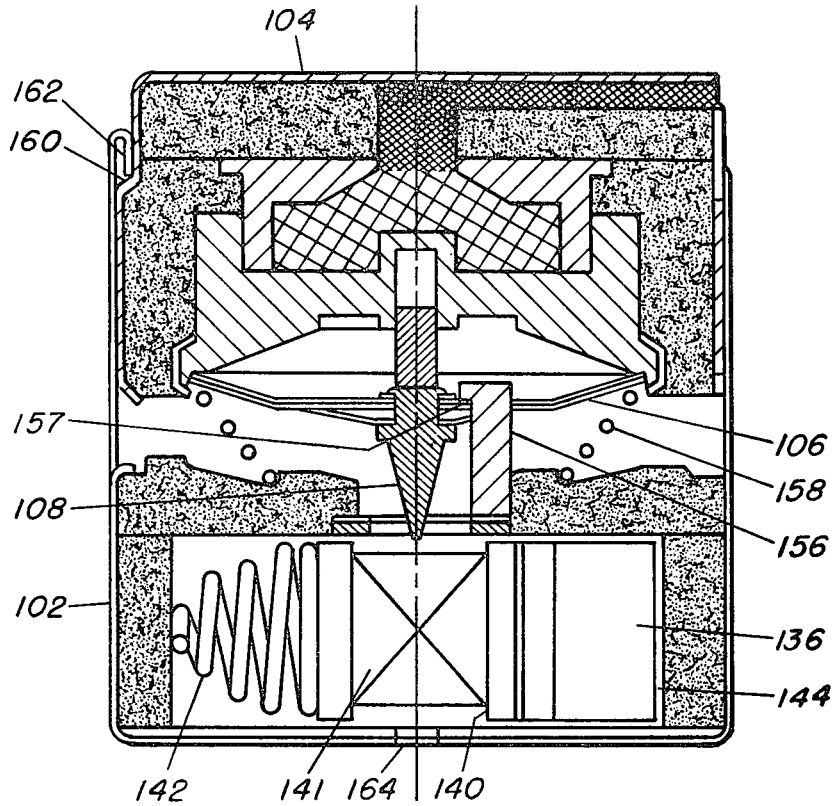
FIG. 2 illustrates the fuze of FIG. 1 in an armed position.
Figure 3:
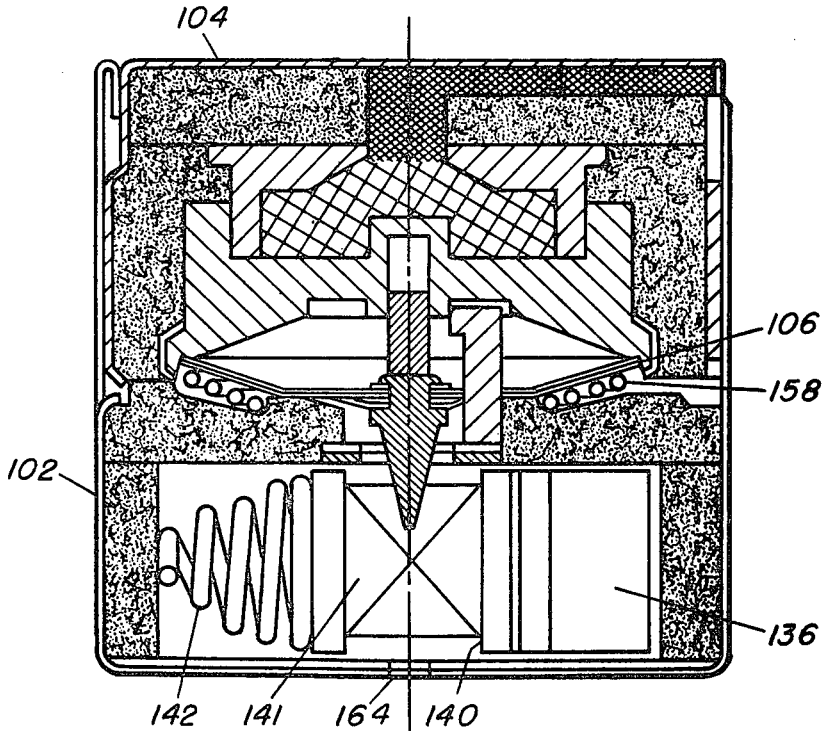
FIG. 3 illustrates the fuze of FIG. 1 in impact functioning position.
Figure 4:
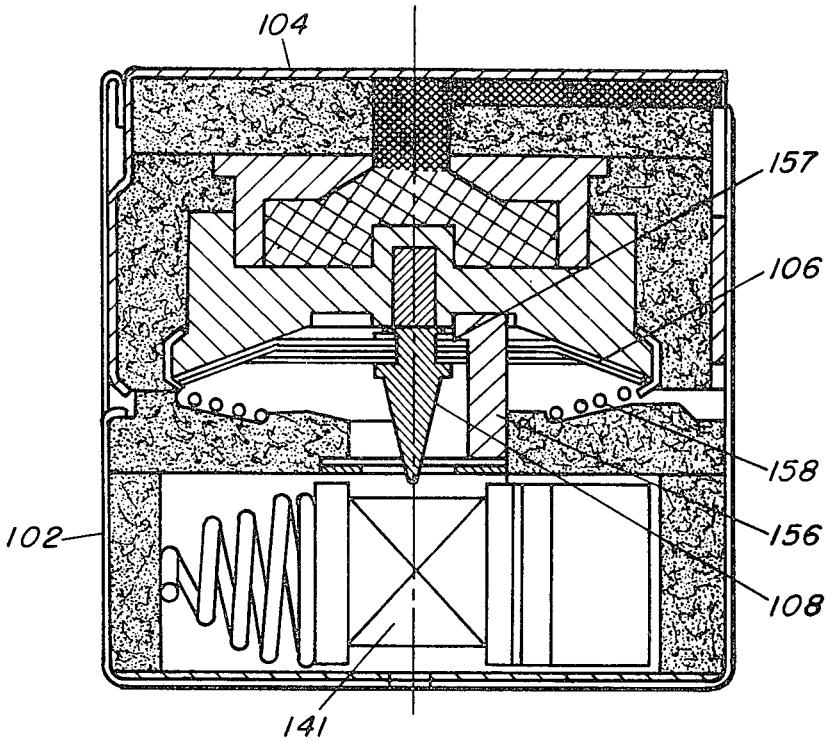
FIG. 4 illustrates the fuze of FIG. 1 in an armed position with impact functioning by-passed.
Figure 5:
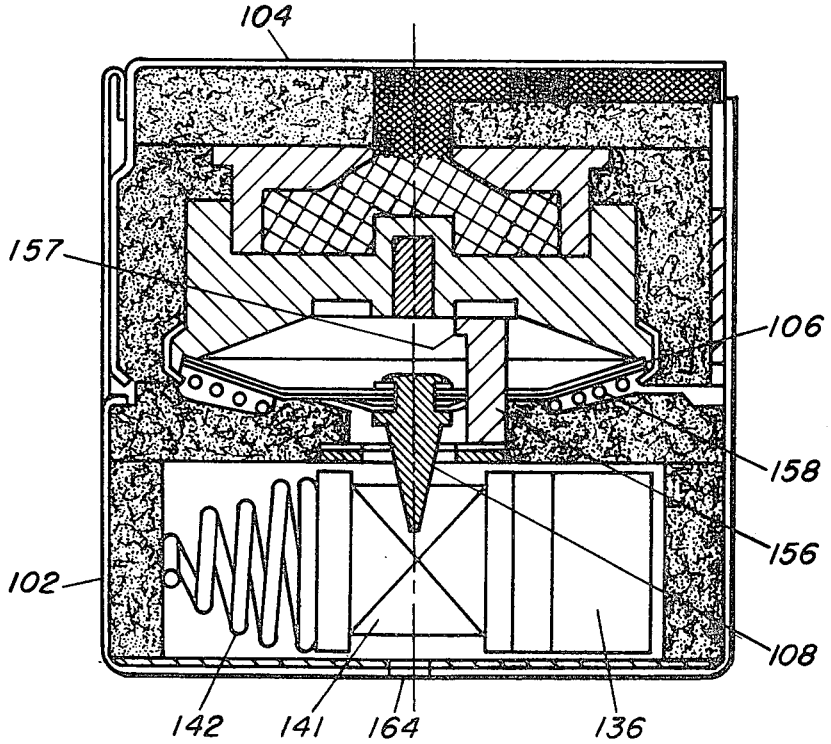
FIG. 5 illustrates the fuze of FIG. 1 in self-destruct functioning position.

Accordingly, when the submunitions are ejected from the projectile, the fuzes are automatically converted to the armed position shown in FIG. 2, as follows: the compression spring 158 expands against the Belleville spring 106, which pushes the Belleville spring 106 and striker cup 104 upward until the spring is stopped by the catch 157 on the inversion post 156 and the cup 104 is stopped by the projection 162 in the rim of cup 102, thereby retracting the firing pin 108 from the slider recess 138 and releasing the slider 136. The slider spring 142 then pushed the released slider to the end of chamber 144, during which the slider is turned 90° by means of a slot in its surface engaging a pin (not shown), whereby the detonator charge 141 in bore 140 is positioned in axial alignment with both the firing pin 108 and the axial opening 164 in the bottom of cup 102 communicating with the main explosive charge of the submunition. Consequently, if the submunition impacts the earth or other solid target less than 10 seconds after the aforementioned ignition, the striker cup 104 is pushed forward, thereby overcoming the compression spring 158 and causing the firing pin 108 to strike the detonator charge 141 and function the submunition, as shown in FIG. 3. However, if the submunition does not impact the earth within 10 seconds following the ignition, the fuze is converted from the armed position shown in FIG. 2 to the armed position shown in FIG. 4, wherein the impact detonation functioning of the fuze is by-passed, as follows: Ten seconds after the ignition, the bimetallic Belleville spring 106 inverts due to the heat from the pyrotechnic composition. However, the Belleville spring 106 is held near its center containing the firing pin 108 by the locking means represented by the catch 157 on the inversion post 156, so that when said spring inverts, it overcomes the compression spring 158 without moving the firing pin 108 and thereby draws the slider cup 104 down to the armed position shown in FIG. 4. In that position the slider cup 104 cannot move forward, since the rigid insulation members 122 and 148 are in contact with each other, with the result that the fuze cannot function on impact with the ground. The fuze will then remain in such armed position or condition until the bimetallic spring 106 has cooled to a temperature sufficient to cause it to snap-back to its original position. Since the mass of the cup 104, including the bimetallic spring module-heat sink-insulation assembly, is many times, e.g., 100 times, greater than the mass of the firing pin 108, it provides sufficient inertia to enable the bimetallic Belleville spring to snap-back and thereby impinge the firing pin on the detonator 141 and explode the submunition before the compression spring 158 overcomes the inertia of said cup, as shown in FIG. 5.

The projectile also can be loaded in the foregoing manner with a plurality of submunitions containing bimetallic spring delay modules of different thermal and hence time delay characteristics, e.g., by use of differing bimetallic Belleville spring elements. By eliminating or by-passing the impact functioning of the fuze as described above, the resulting projectile is capable of delivering and dispersing a large number of random detonating submunitions to a desired area and thereby effectively "pin down" a hostile force for a substantial period of time.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

I claim:

1. A fuze providing delay arming, impact functioning, random time functioning and/or self-destruct functioning of a munition, which comprises in combination:

a cup containing a detonator charge and a safing and arming means;

a striker cup, slidably nested in said detonator containing cup;

a bimetallic spring delay module, fixedly mounted in said striker cup, comprising a bimetallic spring containing a firing pin, and a pyrotechnic charge for heating said spring, wherein said spring inverts by heat from a first stable position to a second stable position after expiration of a first predetermined delay period following ignition of said pyrotechnic charge, and reverts to said first stable position on cooling after expiration of a second predetermined delay period;

a biasing means intermediate said cups for moving the cups oppositely, whereby the fuze is converted from a safe condition to an armed condition via said safing and arming means;

a means for locking the bimetallic spring when it inverts, so that during such inversion the bimetallic spring overcomes said biasing means without contact of the integral firing pin with the detonator, and thereby moves and seats the striker cup against the detonator containing cup so as to prevent further movement of the striker cup toward the detonator;

whereby a. prior to the expiration of the first delay period required to invert the bimetallic spring, impact of the fuze with the ground overcomes said biasing means and thereby drives the firing pin into the detonator; and b. after the expiration of said first delay period, the bimetallic spring inverts while held by said locking means, thereby overcoming said biasing means and seating the striker cup against the detonator containing cup so as to prevent movement of the striker cup toward the detonator, whereby the fuze cannot function on impact with the ground but self-destruct functions when the bimetallic spring reverts on cooling after expiration of said second delay period and thereby drives the firing pin into the detonator.

2. The fuze according to claim 1, wherein the safing and arming means comprises a spring biased slider or rotor containing a recess for receiving the firing pin when the fuze is in a safe condition and a detonator which is aligned with the firing pin when the fuze is in an armed condition.

3. The fuze according to claim 1, wherein the biasing means is a compression spring.

4. A munition comprising a main explosive charge and a fuze according to claim 1 for detonating said explosive charge.

5. The fuze according to claim 1, where the bimetallic spring is a bimetallic Belleville spring.

6. The fuze according to claim 5, wherein the bimetallic spring is peripherally attached to a heat sink.

7. The fuze according to claim 6, wherein the heat sink has a chamber containing said pyrotechnic charge which is in contact with an initiation mixture communicating with the exterior of said fuze through an opening in the sidewall of said striker cup.

8. The fuze according to claim 6, wherein the striker cup and the detonator containing cup are provided with thermal insulation means for retaining the heat imparted to the heat sink by the pyrotechnic charge.

9. The fuze according to claim 6, wherein the locking means comprises an inversion post, which is mounted in the cup containing the detonator and safing and arming means and extends through an opening in the bimetallic spring, said post being aligned parallel to the longitudinal axis of said cup and having a catch for holding said spring during inversion thereof.

10. A spin stabilized projectile comprising a hollow casing;

a plurality of munitions according to claim 4 arranged in tiers longitudinally of said casing and symmetrically disposed in said tiers around the central axis of said casing;

perforated plates separating said tiers of munitions;

a rear closure plate in said casing for supporting said munitions, said plate adapted to permit firing of the projectile casing from the gun and to be ejected along with said munitions from the rear of said casing; and a nose portion in said casing containing a primary time fuze comprising a first explosive charge adapted to send a flame through said perforated plates for initiating the pyrotechnic charges in the fuzes contained in said munitions;

a second explosive charge adapted to generate sufficient pressure to eject the closure plate and munitions from the rear of the projectile casing; and a timing means for igniting said first and second explosive charges.

11. The projectile according to claim 1, wherein the fuzes contain bimetallic spring delay modules of different time delay characteristics.

12. The projectile according to claim 1, wherein the bimetallie spring of each munition is a bimetallic Belleville spring which is peripheralhy attached to a heat sink and wherein the heat sink has a chamber containing said pyrotechnic charge which is in contact with an initiation mixture communicating with the exterior of said fuze through an opening in the sidewall of said striker cup.

* * * * *